United States Patent [19]

Hart

[11] 3,985,008

[45] Oct. 12, 1976

[54] DOOR LOCK MOUNTING MEANS

[75] Inventor: LeRoy Hart, West Hartford, Conn.

[73] Assignee: Emhart Industries, Inc., Farmington, Conn.

[22] Filed: Aug. 27, 1975

[21] Appl. No.: 608,284

[52] U.S. Cl. ..... 70/224; 292/357

[51] Int. Cl.[2] ..... E05B 15/00

[58] Field of Search ..... 70/224, 443, 448, 451, 70/DIG. 34; 292/356, 357, 337

[56] References Cited

UNITED STATES PATENTS

| | | | |
|---|---|---|---|
| 2,547,256 | 4/1951 | Cerf | 70/448 X |
| 2,615,745 | 10/1952 | Young | 292/356 X |
| 2,707,649 | 5/1955 | Young | 292/356 X |
| 3,065,014 | 11/1962 | Russell | 292/356 |
| 3,298,094 | 1/1967 | Russell et al. | 292/337 X |

*Primary Examiner*—J. Franklin Foss
*Attorney, Agent, or Firm*—McCormick, Paulding & Huber

[57] ABSTRACT

A cylindrical lock has a casing mounted in a transverse opening in a door and includes an outer knob spindle sleeve which extends axially outwardly from the casing. An outer rose liner received on the sleeve has spurs which engage the outer face of the door to secure it against rotation relative to the door. A tab on the rose liner received in a groove in the sleeve prevents rotation of the sleeve and casing relative to the outer rose liner. An outer thimble threaded onto the sleeve retains the outer rose liner and an outer rose, which covers it, in assembly with the sleeve. A projection on the outer rose received in a recess in the outer rose liner prevents rotation of the rose relative to the rose liner. The thimble conceals the latter connection and has a slot in its inner end which receives a portion of the locking tab to secure the thimble against rotation relative to the rose liner and the sleeve.

15 Claims, 7 Drawing Figures

DOOR LOCK MOUNTING MEANS

BACKGROUND OF THE INVENTION

This invention relates in general to means for securing a door lock in assembly with a door and more particularly to means for securing a lock of a type which includes a case for mounting in a transverse opening in a door, an outer rose liner and an outer rose received on an outer knob spindle sleeve which projects outwardly from the case, and an outer thimble threaded onto the sleeve to retain the outer rose liner and rose thereon whereby to provide a closure for the transverse opening in the door. Experience with locks of the aforedescribed type has shown that if sufficient wrench torque is applied to the outer thimble it usually can be threaded or backed outward or away from the outer face of the door to allow the rose and rose liner to be moved away from the door face to expose the opening in the door and the lock case contained therein. Where the connection between the latch bolt and the operating mechanism is of a releasable type, it is usually a simple matter to retract the latch bolt and thereby release the door by applying force to the releasable connection in the direction of retraction by inserting a suitable tool behind the rose and rose liner and into the opening in the door. In a lock of the aforedescribed general type it is also desirable to provide means to prevent rotation of the outer rose or trim relative to the face of the door, particularly when the rose has a noncircular configuration, so that it remains properly oriented relative to the door. This invention is concerned with the aforedescribed general problems.

SUMMARY OF THE INVENTION

In accordance with the present invention a door lock which has a casing, an outer knob spindle sleeve mounted in fixed position on the casing and extending axially outwardly therefrom, an outer rose liner and an outer rose mounted on the knob spindle sleeve, and an outer thimble threaded onto the sleeve to retain the outer rose liner and outer rose has a radially outwardly opening groove in its sleeve which receives a radially inwardly extending locking tab on the rose liner to secure the rose liner against rotation on and relative to the sleeve. The outer thimble has an axially inwardly opening slot in its inner end which receives the locking tab therein to restrain the thimble against rotation on and relative to the sleeve when the lock is assembled with an associated door. Connection may be provided between the outer rose and outer rose liner to prevent rotation of the outer rose. The thimble conceals the latter connection.

DETAILED DESCRIPTION OF PREFERRED EMBODIMENT

Figure 1:
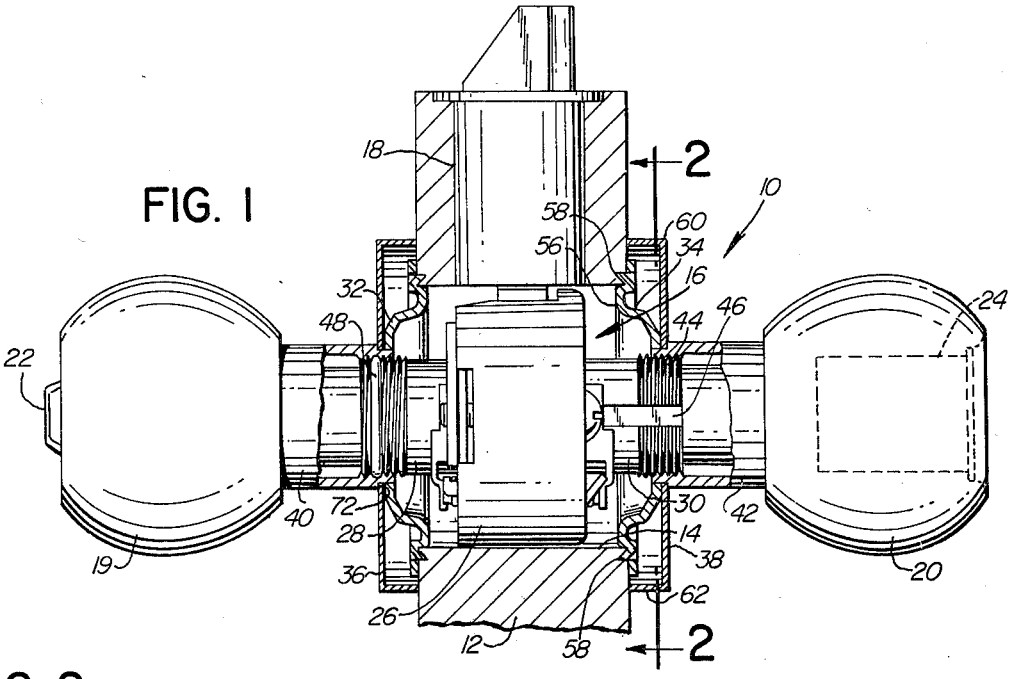
FIG. 1 is a fragmentary plan view of a door lock assembly embodying the present invention shown assembled with a door, the door and portions of the lock assembly being shown in horizontal section.

Turning now to the drawing, a cylindrical lock assembly embodying the present invention and indicated generally by the reference numeral 10 is shown mounted on a door 12 which has a transverse cylindrical bore 14 therethrough. The lock assembly 10 comprises an operating unit indicated generally at 16 and mounted in the bore 14 and a latch bolt unit 18 mounted in another bore which intersects the bore 14 and opens through the edge of the door 12. The latch bolt unit 18 is releasably connected in a conventional manner to operating mechanism associated with the operating unit for retraction in response to operation of either an inner knob 19 or an outer knob 20. Locking mechanism (not fully shown) is provided to selectively enable or disable the outer knob 20, so that the door may be locked to prevent entry from the outer side, and includes inner locking mechanism operated by a turn button 22 associated with the inner knob 19 and a conventional lock cylinder 24 mounted in the outer knob 20.

Considering now the operating unit in further detail, and more particularly the manner in which it is retained in assembly with the door 12, the operating unit 16 comprises a generally cylindrical casing coaxially received within the bore 14 and which has inner and outer tubular knob spindle sleeves respectively indicated at 28 and 30 mounted in fixed position thereon. The inner and outer sleeves are generally cylindrical and project axially outwardly from opposite sides of the casing 26 and beyond associated inner and outer faces of the door 12, substantially as shown in FIG. 1, to provide journal support for inner and outer knob spindles to which the inner and outer knobs 19 and 20 are respectively attached. The operating unit 16 further includes inner and outer rose liners 32 and 34, respectively received on the inner and outer sleeves 28 and 30, which provide closures for the inner and outer ends of the bore 14. A pair of roses, respectively indicated at 36 and 38, cover the rose liners 32 and 34 and comprise the finished trim for the lock assembly 10. The roses and rose liners are retained in engagement with the opposite faces of the door 12 by adjustable inner and outer thimbles 40 and 42 which respectively threadably engage the inner and outer sleeves 28 and 30. Each rose liner has retaining means which engage an associated face of the door to hold the rose liner in fixed position relative to the door as will be hereinafter further discussed. In accordance with the present invention a means is provided to prevent rotation of the outer spindle sleeve and the outer thimble relative to the outer rose liner whereby the operating unit 16 is retained in fixed position within the bore 14. A means is also provided to connect the outer rose to the outer rose liner to maintain the outer rose in fixed relation to the door.

Figure 2:
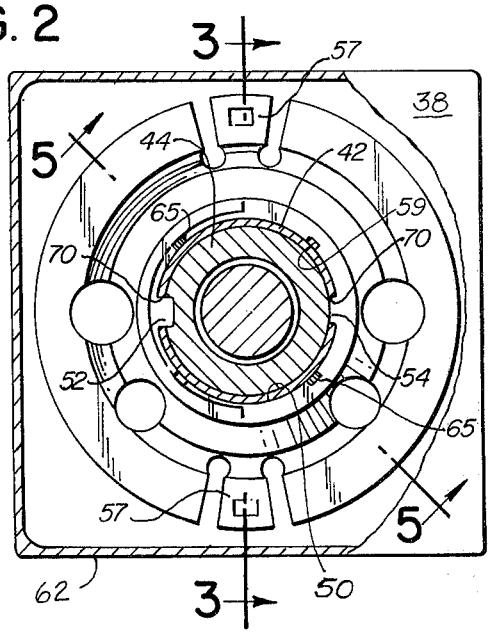
FIG. 2 is a somewhat enlarged sectional view taken along the line 2—2 of FIG. 1.
Figure 4:
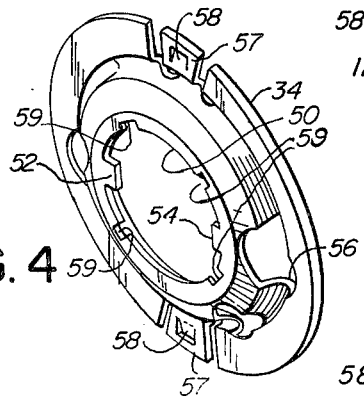
FIG. 4 is a perspective view of the outer rose liner.
Figure 7:
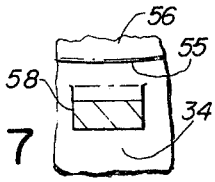
FIG. 7 is a fragmentary sectional view taken along the line 7—7 of FIG. 6.

The outer knob spindle 30 has a threaded portion 44 on its exterior surface and a radially outwardly opening groove 46 formed therein which extends in an axial direction through the threaded portion. The inner sleeve 28 is also threaded on its exterior surface and has an annular groove in its threaded portion which contains an O-ring 48 made from a suitable resilient material such as rubber. The outer rose liner 34, best shown in FIGS. 2 and 4, comprises a circular plate which has a generally cylindrical central opening 50 somewhat larger than the diameter of the threaded portion 44, to receive the outer sleeve 30 therethrough. An integral locking tab 52 projects radially into the opening 50 and is received in the groove 46 to restrain the outer rose liner 42 against rotation relative to the outer sleeve 30. Another integral tab 54 projects radially into the opening 50 in diametrically opposed relation to the locking tab 52. The tabs 52 and 54 respectively engage diametrically opposite portions of the outer sleeve 30 to maintain the outer rose liner 34 in generally coaxially alignment with the outer sleeve while the lock assembly 10 is installed on an associated door, as will be hereinafter further discussed. A coaxial annular bead 56 formed on the outer rose liner has a cylindrical portion 55 which is received within the bore 14 and engages the wall thereof, as shown in FIG. 1, to coaxially align the outer knob spindle 30 with the bore 14. A plurality of integral cantilever tabs 57, 57 project in a radial direction from the rose liner 34. Spurs 58, 58 struck from or otherwise formed on the tabs 57, 57 cooperate with the outer face of the door 12 to prevent rotation of the outer rose liner 34 relative thereto when the lock assembly 10 is assembled with the door. Each spur 58 is of a key type and has a generally rectangular cross section as best shown in 7. The outer rose liner 34 also has a circumaxial series axially outwardly opening recesses 59, 59 defined by notches which open into the central opening 50.

Figure 3:
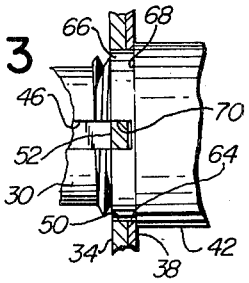
FIG. 3 is a sectional view taken generally along the line 3—3 of FIG. 2.
Figure 6:
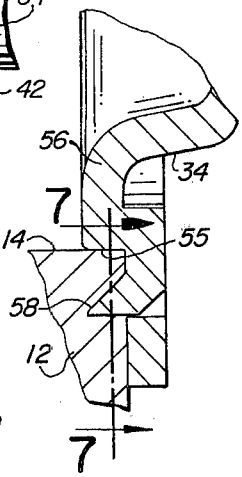
FIG. 6 is a somewhat enlarged fragmentary horizontal sectional view of the door lock assembly and door of FIG. 1.
Figure 5:
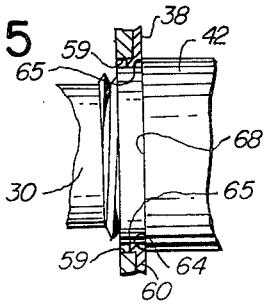
FIG. 5 is a sectional view taken along the line 5—5 of FIG. 2.

The illustrated rose 38 comprises a cup shaped trim member which has a generally radially disposed portion 60 and a non-circular peripheral portion 62. An aperture 64 formed in the portion 60 receives the sleeve 30 therethrough and has a diameter substantially equal to the diameter of the opening 50 in the outer rose liner 34. The rose 38 also has a plurality of axially inwardly struck projections 65, 65 near the aperture 64 for engaging the outer rose liner 34 within associated recesses 59, 59. The outer thimble 42 which retains the outer rose 38 and the outer rose liner 34 in assembly with the sleeve 30 comprises a generally cylindrical tubular member, internally threaded at its inner end to threadably engage the threaded portion 44. The thimble 42 has an inner end portion 66 the diameter of which is smaller than the diameter of the remainder of the thimble and substantially equal to the diameter of the aperture 64 and the opening 50, as best shown in FIG. 3. The thimble 42 has a radially disposed axially inwardly facing shoulder 68 adjacent its inner end portion 66 and a pair of diametrically opposed axially inwardly opening slots 70, 70 formed in its inner end portion 66 which respectively receive the tabs 52 and 54. When the lock assembly 10 is assembled on the door 12 the shoulder 68 engages the outer rose 38, which overlies the outer rose liner 34, to retain the outer rose and outer rose liner in engagement with the outer face of the door 12. The shoulder 68 also overlies and substantially covers the projections 65, 65, thereby concealing the connection between the outer rose 38 and outer rose liner 34.

The inner rose liner 32 is identical in most respects to the outer rose liner 34, and has a generally circular central opening therein somewhat larger than the diameter of the associated threaded portion of the inner sleeve 28. However, it should be noted that the inner rose liner 32 does not include integral tabs which correspond to the tabs 52 and 54. The illustrated inner rose 36 is substantially identical to the outer rose 38, previously described, and has a central aperture therein the diameter of which is substantially equal to the diameter of the central opening in the inner rose liner 32. The inner thimble 40 is similar in most respects to the outer thimble 42. It is threaded at its outer end to engage the threads on the inner sleeve 28 and cooperates in opposing relation with the outer thimble 42 to retain the inner rose 36 and inner rose liner 32 in engagement with the inner face of the door 12. However, the inner thimble 40 is not slotted at its outer end and may be rotated relative to the inner rose liner 32.

When the lock assembly 10 is installed on a door, such as the door 12, the outer rose liner 34 and outer rose 38 are first positioned on the outer sleeve 30. The outer thimble 42 is then threadably adjusted relative to the outer sleeve 30 so that the casing 26 will be transversely centered within the bore 14 when the outer rose liner 34 and outer rose 38 are positioned in engagement with the outer face of the door with the tabs 52, 54 respectively received in the slots 70, 70. After this initial adjustment has been made, the latch bolt unit 18 is assembled in its associated bore opening and the operating unit is inserted from the outer side of the door 12 through the bore 14 to effect operative connection between the latch bolt unit 18 and operting unit 16, in a manner well known in the art. The outer rose 38 is next oriented in desired angular position relative to the door face after which projections 65, 65 are engaged in appropriate recesses 59, 59 to maintain the outer rose in proper orientation. The cylindrical portion 55 on the outer rose liner engages the wall of the bore 14 to effect general coaxial alignment between the operating unit 16 and the bore 14. Thereafter, the inner rose liner 32 and inner rose 36 are positioned on the inner sleeve 28 and in general engagement with the inner face of the door. The cylindrical portion 55 on the inner rose liner cooperates with the bore 14 to coaxially align the inner rose liner 32 with the bore 14. The inner rose 36 may now be oriented with the inner face of the door and brought in connected engagement with the inner rose liner 32, in the manner generally aforedescribed. The inner thimble 40 is next threaded into engagement with the inner sleeve to bring the outwardly facing shoulder 72 into bearing engagement with the inner rose 36. The inner thimble 40 may then be tightened, using a spanner wrench or the like, to cause the spurs on the inner and outer rose liners to dig into the respective inner and outer faces of the door, in the case of a wooden door, or to enter preformed openings, in the door, where the door is made from metal or like material. The assembly is completed by installing the inner knob 19 on the shank of the inner knob spindle. Suitable means (not shown) may be provided for securing the outer knob 20 to its associated knob spindle, so that it cannot be removed therefrom without first moving the operating unit 16 out of assembled relation with the door 12. The adjustable thimbles 40 and 42 permit adjustment of the lock assembly 10 for installation on doors in a range of widths. The thimbles also serve to conceal the connection between each rose and its associated rose liner. The cylindrical portions 55, 55 on the inner and outer rose liners cooperate with the bore 14 to resist movement of the lock assembly relative to the door 12 in response to downwardly directed pressure on either knob.

When the lock 10 is assembled on a metal door the key type spurs 58, 58 enter preformed opening or standard pierced slots in the faces of the door. The generally rectangular cross section of each spur 58 is adapted to complement an associated rectangular slot in the door, whereby to restrain an associated rose liner against movement relative to the face of the door.

I claim:

1. In a door lock assembly having a casing for mounting in a transverse opening in a door and including a tubular outer sleeve mounted in fixed position on said casing and projecting axially outwardly therefrom in a transverse direction relative to the door for supporting a knob spindle extending axially outwardly therethrough, said outer sleeve having a thread on its exterior surface, a radially disposed outer rose liner for engaging an associated portion of the face of the door and having an opening receiving said outer sleeve therethrough, means for restraining said outer rose liner against rotation relative to the door, an outer rose received on said outer sleeve outwardly of said rose liner and having a circular aperture therein receiving said outer sleeve coaxially therethrough, said outer rose having a generally radially disposed portion overlying an associated portion of said rose liner and a peripheral skirt generally surrounding the outer periphery of said outer rose liner for engaging the outer face of the door, and a tubular outer thimble threaded onto said outer sleeve, said thimble having a radially disposed axially inwardly facing shoulder engaging said outer rose for retaining said skirt in engagement with the face of the door, the improvement comprising said outer sleeve having an axially extending generally radially outwardly opening groove therein, said outer rose liner having an integral locking tab projecting generlly radially inwardly of said opening and disposed in said groove for restraining said outer sleeve against rotation relative to said outer rose liner, and said outer thimble having a generally cylindrical inner end portion extending axially inwardly from said shoulder through said aperture and into said opening, said inner end portion having an axially inwardly opening slot receiving said locking tab therein, said locking tab cooperating with said groove and said slot to restrain said outer thimble against rotation relative to said outer sleeve.

2. In a door lock assembly as set forth in claim 1 the combination wherein said opening in said outer rose liner is substantially larger than the outside diameter of said outer sleeve and said outer rose liner includes another tab extending radially inwardly of said opening in diametrically opposed relation to said locking tab and said locking tab and said other tab engage diametrically opposite portions of said outer sleeve to maintain said outer rose liner in a predetermined position of alignment with said outer sleeve.

3. In a door lock assembly as set forth in claim 2 the combination wherein said opening is generally circular and said inner end portion has a diameter substantially equal to the diameter of said opening and an axially inwardly opening slot receiving said other tab therein.

4. In a door lock assembly as set forth in claim 1 the combination wherein said restraining means comprises a spur formed on said outer rose liner for engaging the outer face of the door.

5. In a door lock assembly as set forth in claim 4 the combination wherein said outer rose has an integral contilever tab and said spur is formed on a free end portion of said cantilever tab.

6. In a door lock assembly as set forth in claim 5 the combination wherein said cantilever tab projects in a radial direction from said rose liner.

7. In a door lock assembly as set forth in claim 4 the combination wherein said spur has a generally rectangular cross-section.

8. In a door lock assembly as set forth in claim 1 the combination wherein one of said members comprising said outer rose liner and said outer rose has a projection and the other of said members has a recess receiving said projection and cooperating with said projection to form a connection between said outer rose liner and said outer rose preventing rotation of said outer rose relative to said outer rose liner and said thimble conceals said connection.

9. In a door lock assembly as set forth in claim 8 the combination wherein said projection comprises an axially directed projection and said axially inwardly facing shoulder overlies said connection.

10. In a door lock assembly as set forth in claim 9 the combination wherein said one member comprises said outer rose and said other member comprises said outer rose liner.

11. In a door lock assembly as set forth in claim 1 the combination wherein said outer rose liner has an axially inwardly directed cylinder portion for engaging an associated portion of a generally cylindrical opening in a door in which opening said cylindrical portion is received.

12. In a door lock as set forth in claim 11 the combination wherein said retaining means comprises a spur on said outer rose liner having a generally rectangular cross section.

13. In a door lock assembly having a casing for mounting in a transverse opening in a door and including a tubular outer sleeve mounted in fixed position on said casing and projecting axially outwardly therefrom in a transverse direction relative to the door for supporting a knob spindle extending axially outwardly therethrough, said outer sleeve having a thread on its exterior surface, a radially disposed outer rose liner for engaging an associated portion of the face of the door and having an opening receiving said outer sleeve therethrough, means for restraining said outer rose liner against rotation relative to the door, an outer rose received on said outer sleeve outwardly of said rose liner and having a circular aperture therein receiving said outer sleeve coaxially therethrough, said outer rose having a generally radially disposed portion overlying an associated portion of said rose liner and a peripheral skirt generally surrounding the outer periphery of said outer rose liner for engaging the outer face of the door, and a tubular outer thimble threaded onto said outer sleeve, said thimble having a radially disposed axially inwardly facing shoulder engaging said outer rose for retaining said skirt in engagement with the face of the door, the improvement comprising one of said members comprising said outer rose liner and said outer rose having a projection and the other of the members having a recess receiving said projection and cooperating with said projection to form a connection between said outer rose liner and said outer rose preventing rotation of said outer rose relative to said outer rose liner, said thimble concealing said connection, and said combination including means for restraining said outer sleeve against rotation relative to said outer rose liner and means for restraining said thimble against rotation relative to said outer rose liner.

14. In a door lock assembly as set forth in claim 13 the combination wherein projection comprises an axially directed projection and said axially inwardly facing shoulder overlies said connection.

15. In a door lock assembly as set forth in claim 14 the combination wherein said one member comprises said outer rose and said other member comprises said outer rose liner.

* * * * *